US010684096B2

(12) United States Patent
Williams

(10) Patent No.: US 10,684,096 B2
(45) Date of Patent: Jun. 16, 2020

(54) REFLEX SIGHT WITH ENVIRONMENTAL SEAL ON PIVOTING ELEMENT

(71) Applicant: Leupold & Stevens, Inc., Beaverton, OR (US)

(72) Inventor: Gibson Larson Williams, Beaverton, OR (US)

(73) Assignee: LEUPOLD & STEVENS, INC., Beaverton, OR (US)

( * ) Notice: Subject to any disclaimer, the term of this patent is extended or adjusted under 35 U.S.C. 154(b) by 0 days.

(21) Appl. No.: 16/043,526

(22) Filed: Jul. 24, 2018

(65) Prior Publication Data

US 2019/0049218 A1 Feb. 14, 2019

Related U.S. Application Data

(60) Provisional application No. 62/542,299, filed on Aug. 8, 2017.

(51) Int. Cl.
*F41G 1/38* (2006.01)
*F41G 1/30* (2006.01)

(52) U.S. Cl.
CPC ..... *F41G 1/30* (2013.01)

(58) Field of Classification Search
CPC ..... F41G 1/30; F41G 1/38
USPC ..... 42/113, 122, 123
See application file for complete search history.

(56) References Cited

U.S. PATENT DOCUMENTS 6,807,742 B2 * 10/2004 Schick ..... F41G 1/30 33/297

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A reflex sight with environmental seal on pivoting element has an outer housing defining a chamber and having a forward end defining a forward opening having a seat surface and an opposed rear end, an inner frame received within the chamber and having a forward end registered with the housing forward end and an opposed rear end, the forward end of the inner frame defining a forward aperture sealably receiving a transmissive optical element, a seal element encompassing the forward end of the inner frame and closely received in the forward opening of the outer housing to sealably contact the seat surface and provide an environmental seal, and an aiming mechanism operably interconnected to the outer housing and the inner frame to adjustably position the rear end of the inner frame with respect to the housing. The seat surface may be a concave curved surface or a spherical surface portion.

20 Claims, 4 Drawing Sheets

REFLEX SIGHT WITH ENVIRONMENTAL SEAL ON PIVOTING ELEMENT

CROSS-REFERENCE TO RELATED APPLICATION

This application claims the benefit of U.S. Provisional Patent Application No. 62/542,299 filed on Aug. 8, 2017, entitled "ENVIRONMENTAL SEAL ON PIVOTING ELEMENT," which is hereby incorporated by reference in its entirety for all that is taught and disclosed therein.

FIELD OF THE INVENTION

The present invention relates to sighting systems for projectile weapons and, more particularly, to a reflex sight system with an aiming mark for aiming under multiple different shooting situations.

BACKGROUND OF THE INVENTION

Conventional reflex sights are optical aiming sights for projectile weapons—such as rifles, pistols, and crossbows, for example—that reflect an aiming mark on a reflector for superimposition on a distant target. Typically, the reflector is spherical and partially reflective or reflective of a specific wavelength of light. Some reflex sights use a collimating lens and a flat reflector, rather than a spherical or aspherical reflector. In either approach, the reflected light reaches the user's eye as collimated light, so that the user will see an image of the aiming mark superimposed in the sight's field of view in focus at all distances. The sight is affixed to the weapon and aimed so that the aiming mark coincides with a point of impact of a projectile at a predetermined sighted-in range, when fired or launched from the weapon.

Since the image of the aiming mark produced by the reflex sight is made up of collimated light aligned with the weapon, the aiming feature appears to be parallax free. That is, the user can look through the reflector from any vantage point and the aiming feature will appear stationary on the target at infinity so long as the target is viewed through the reflector.

Conventional reflex sights/rifle scopes sometimes use a collimated subassembly/pivot tube having a light or other illumination source, reflector, and frame with the pivot tube pivotally mounted within a housing/maintube by a pivoting ball seat. The housing provides the collimated subassembly with environmental protection, and the pivoting ball seat enables a range of windage and elevation adjustment of the collimated subassembly. Typically, a second window or lens located behind the collimated subassembly is sealed in place to provide environmental protection. The need for a second lens adds cost, weight, and complexity to a conventional reflex sight/rifle scope.

In addition, the sealed second lens prevents access to the collimated subassembly in the event the collimated subassembly becomes damaged. The inability to easily remove the second lens from the housing can make repair or replacement of the collimated subassembly more complex and expensive.

Thus, although conventional reflex sights are generally suitable for their intended purpose, they can suffer from impaired image quality and are difficult to repair. Therefore, a need exists for a new and improved reflex sight that omits a second sealed lens between the pivot tube and the environment, resulting in improved image quality, ease of repair, and ease of assembly during manufacturing. In this regard, the various embodiments of the present invention substantially fulfill at least some of these needs. In this respect, the reflex sight system according to the present invention substantially departs from the conventional concepts and designs of the prior art, and in doing so provides an apparatus primarily developed for the purpose of providing improved image quality and ease of repair.

SUMMARY OF THE INVENTION

The present invention provides an improved reflex sight with environmental seal on pivoting element, and overcomes the above-mentioned disadvantages and drawbacks of the prior art. As such, the general purpose of the present invention, which will be described subsequently in greater detail, is to provide an improved reflex sight with environmental seal on pivoting element that has all the advantages of the prior art mentioned above.

To attain this, the preferred embodiment of the present invention essentially comprises an outer housing defining a chamber and having a forward end defining a forward opening having a seat surface and an opposed rear end, an inner frame received within the chamber and having a forward end registered with the housing forward end and an opposed rear end, the forward end of the inner frame defining a forward aperture sealably receiving a transmissive or reflective optical element, a seal element encompassing the forward end of the inner frame and closely received in the forward opening of the outer housing to sealably contact the seat surface and provide an environmental seal, and an aiming mechanism operably interconnected to the outer housing and the inner frame to adjustably position the rear end of the inner frame with respect to the housing. The seat surface may be a concave curved surface. The seat surface may be a spherical surface portion. It should also be appreciated that the seal element and seat surface can be located on the ocular/rear end of the outer housing. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
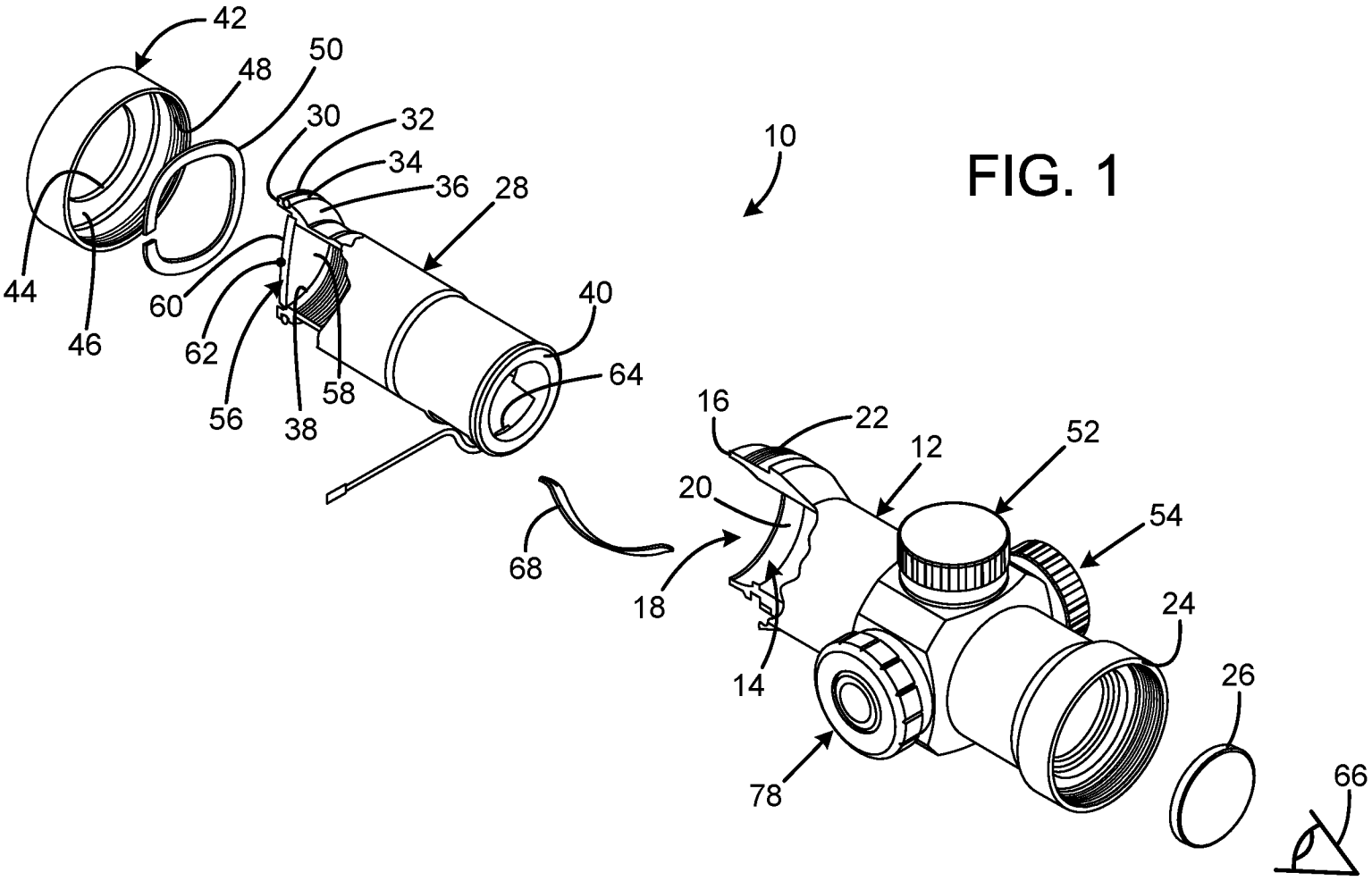
FIG. 1 is a rear isometric exploded view of the current embodiment of the reflex sight with environmental seal on pivoting element constructed in accordance with the principles of the present invention.

An embodiment of the reflex sight with environmental seal on pivoting element of the present invention is shown and generally designated by the reference numeral 10.

Figure 2:
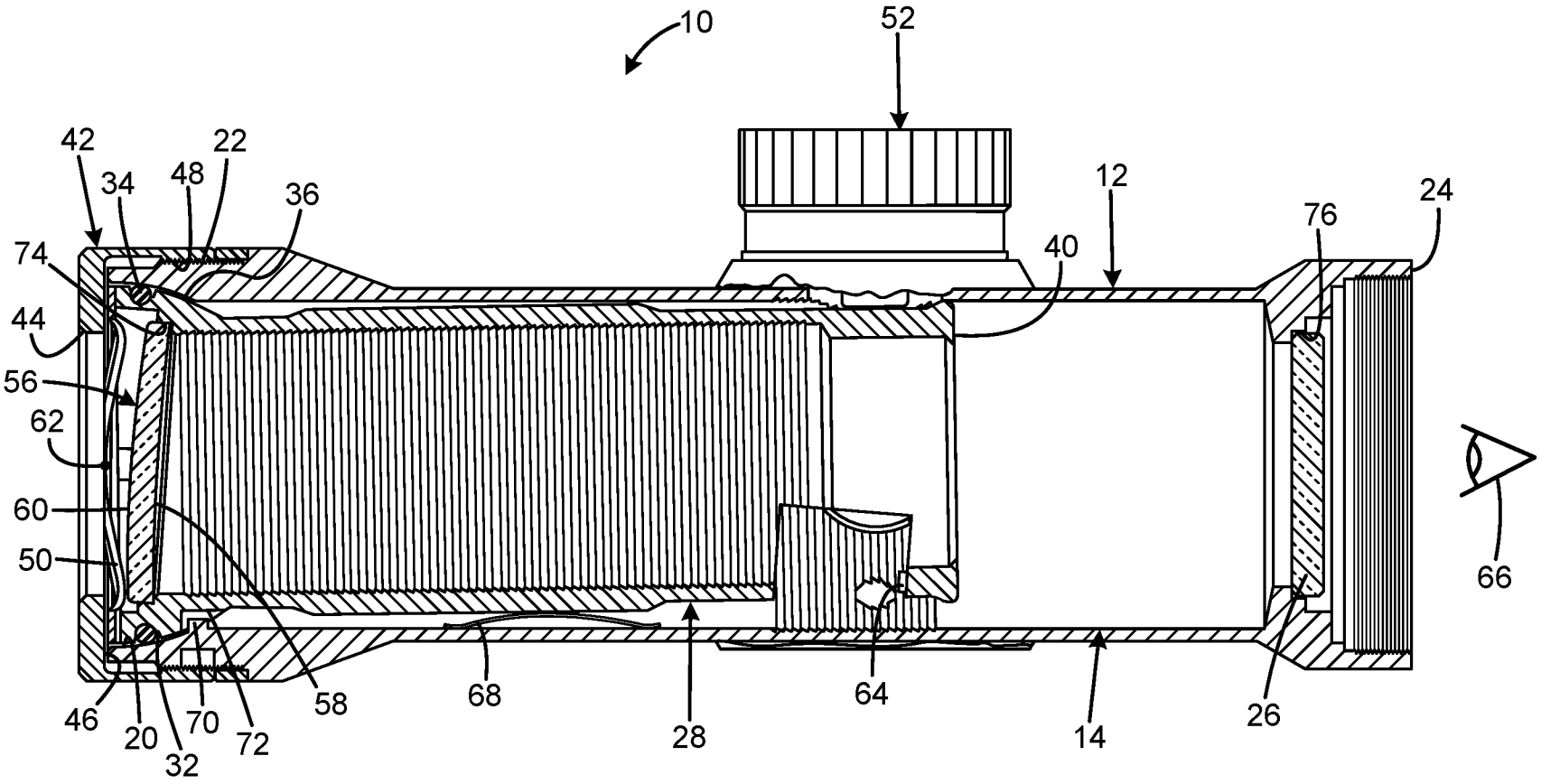
FIG. 2 is a left side sectional view of the current embodiment of the reflex sight with environmental seal on pivoting element of FIG. 1 with the inner frame in the top of travel/minimum elevation position.
Figure 3:
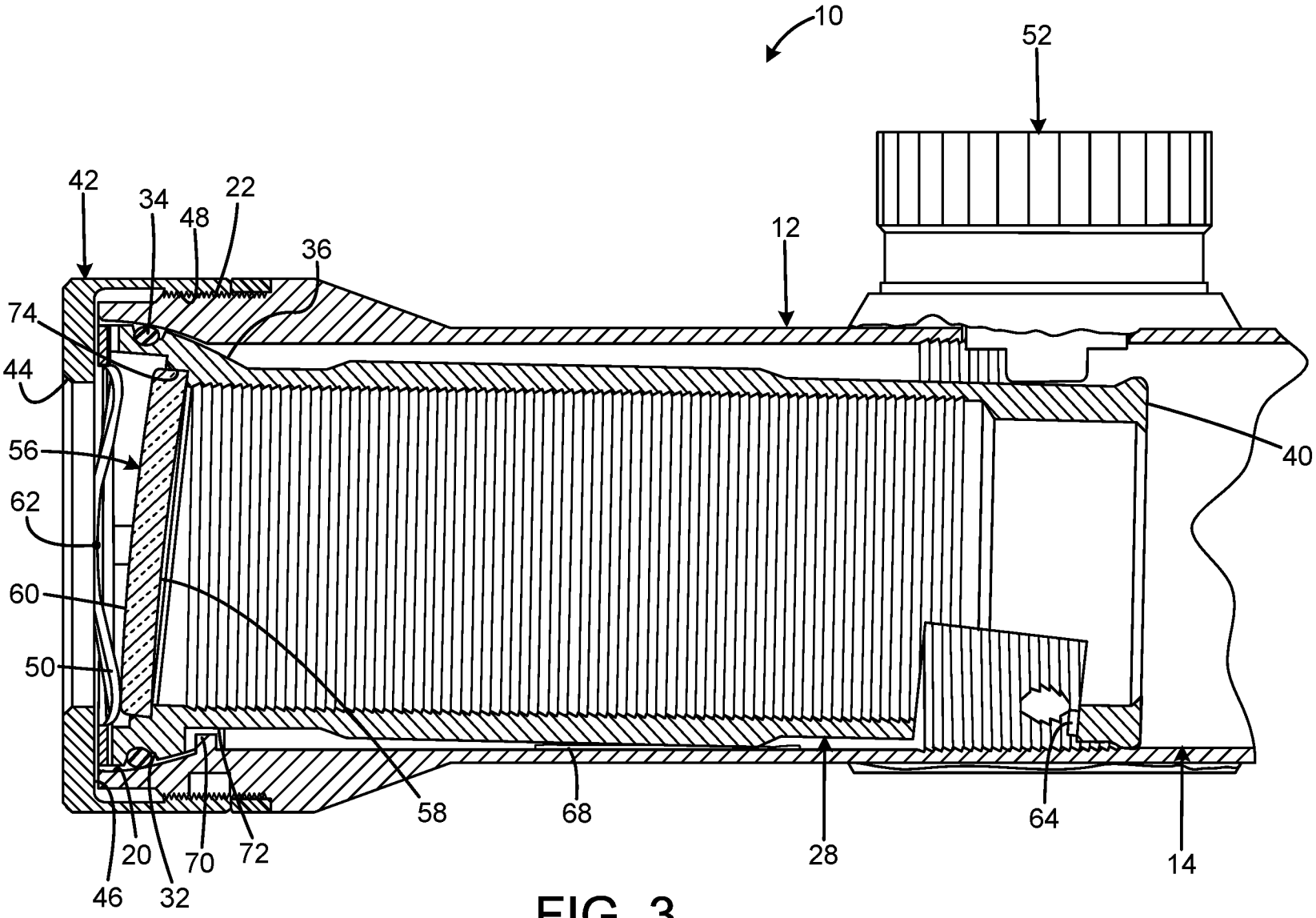
FIG. 3 is a left side sectional view of the current embodiment of the reflex sight with environmental seal on pivoting element of FIG. 1 with the inner frame in the bottom of travel/maximum elevation position.

FIGS. 1-3 illustrate the improved reflex sight with environmental seal on pivoting element 10 of the present invention. More particularly, the reflex sight with environmental seal on pivoting element has an elongated, tubular outer housing 12 defining a chamber 14 and having a forward end 16 defining a forward opening 18 having a seat surface 20. The forward end of the outer housing includes a threaded exterior portion 22. The outer housing also has a rear end 24. A rear optical element 26 is connected to the outer housing at the rear end and encloses the chamber to provide an environmental seal.

An elongated, tubular inner frame 28 is received within the chamber 14. The inner frame has a forward end 30 registered with the outer housing 12 forward end 16. The forward end of the inner frame defines an exterior circumferential groove 32. A seal element 34 encompasses the forward end of the inner frame and is received in the circumferential groove. In the current embodiment, the seal element is an elastomeric ring. The seal element is closely received in the forward opening 18 of the outer housing to sealably contact the seat surface 20 and provide an environmental seal. The forward end of the inner frame has a spherical exterior portion 36. The forward end of the inner frame defines a forward aperture 38. The inner frame also has a rear end 40.

A retaining ring 42 defining an open aperture 44 is removably connected to the outer housing 12 by a threaded interior portion 48 that threadedly engages the threaded exterior portion 22 of the outer housing. The retaining ring has a rear surface 46 that captures the forward end 30 of the inner frame 28. A compressive element 50 is interposed between the retaining ring and the forward end of the inner frame. In the current embodiment, the compressive element is a single turn gap type wave spring manufactured by Smalley Steel Ring Company of Lake Zurich, Ill.

A first aiming mechanism 52 and second aiming mechanism 54 are operably interconnected to the outer housing 12 and the inner frame 28 to adjustably position the rear end 40 of the inner frame with respect to the outer housing in combination with a system spring 68 to align the inner frame to a desired angular disposition relative to the outer housing. In the current embodiment, the first aiming mechanism is a common turret adjustment mechanism for riflescopes for adjusting elevation, and the second aiming mechanism is a common turret adjustment mechanism for riflescopes for adjusting windage. It should be appreciated that a transmissive optical element 56 pivots as the rear end of the inner frame moves.

The forward aperture 38 of the inner frame 28 sealably receives the transmissive optical element 56. In the current embodiment, the transmissive optical element is a non-magnifying element having a concave rear surface 58 and an exposed front surface 60. However, the transmissive optical element 56 can also be reflective. The transmissive optical element is the only optical element at the forward end 16 of the outer housing 12.

In the current embodiment, the seat surface 20 is a concave curved surface, a spherical surface portion, and a band having a width selected to enable a selected angular range of adjustment of the rear end 40 of the inner frame 28 by the first and second aiming mechanisms 52, 54. The top of travel/minimum elevation position of the rear end of the inner frame is shown in FIG. 2, and the bottom of travel/maximum elevation position of the rear end of the frame is shown in FIG. 3. The seat surface is defined by a common radius from a selected center point 62 that is determined by the forward end 30 of the inner frame and not by the geometry of the transmissive optical element 56. In the current embodiment, the center point is the center of pivot of the inner frame 28 and is located forward of the transmissive optical element 56.

The inner frame 28 includes a light emitting element 64 positioned at the rear end 40 of the inner frame to reflect off the transmissive optical element 56 to provide an aiming point as viewed by a user's eye 66 from the rear end 24 of the outer housing 12. The light emitting element is located at the focal point of the transmissive optical element to create a collimated image of a dot when viewed by a user's eye 66. In the current embodiment, the light emitting element is a light emitting diode (LED). In contrast to existing reflex sights where the transmissive optical element is fixed and only the light emitting element moves, the reflex sight 10 enables movement of both the transmissive optical element and the light emitting element as the inner frame pivots relative to the outer housing. An illumination control 78 is operably interconnected to the light emitting element to control the intensity of the illuminated light. The light emitting element can also be mounted to the outer housing instead of to the inner frame.

The seal element 34 creates a dynamic water seal on the seat surface 20 as the spherical exterior portion 36 of the inner frame 28 contacts the seat surface of the outer housing 12. This enables the inner frame to pivot while utilizing an O-ring seal without altering O-ring compression during system stroke, such that the environmental seal is not compromised. In addition to one or more O-rings, similar sealing elements such as wipers can also be used. The seat surface needs to maintain a spherical or near spherical geometry to minimize the difference in water seal preload during adjustment travel of the spherical exterior portion of the inner frame. However, the spherical exterior portion of the inner frame does not need to maintain a spherical geometry to create the dynamic water seal. A spherical geometry is only maintained to increase the contact area between the spherical exterior portion of the inner frame and the seat surface of the outer housing to make the reflex sight 10 more robust against forces to prevent damage. The dynamic water seal would still be created with a line contact between the exterior portion of the inner frame and the seat surface instead of a surface contact between the exterior portion of the inner frame and the seat surface, so a chamfer or conical shape could replace the spherical radius on the exterior portion of the inner frame and maintain full functionality.

Axial rotation of the inner frame 28 is controlled through a dimple 70 in the seat surface 20 of the outer housing 12. The dimple protrudes into a slot 72 cut into the inner frame to prevent significant rotation. There must always be clearance between the slot and the dimple. However, this clearance decreases as the dimple is moved towards the pivot point. The water seal can be positioned on either side of the dimple or anti-rotation feature.

The compressive element 50 is used to supply axial thrust to preload the spherical exterior portion 36 of the inner frame 28 into the seat surface 20 of the outer housing 12. However, the position of the seat surface relative to the spherical exterior portion could also be retained by an objective lock ring that forms a spherical, conical, or other shape that contacts the inner frame directly, eliminating the need to use the compressive element, where thread engagement adjusts backlash and/or supplies preload. This preload or axial thrust may not be required if the seal element 34 is near the tangent point at the top/bottom of the pivot point.

The transmissive optical element 56 functions as part of the dynamic water seal. To optimize the assembly process and improve water seal yield, there is a counterbore 74 to allow the use of glue injector tips to glue the transmissive optical element in place on the outside diameter of the inner frame 28, minimizing the need to contact the exposed front surface 60 of the transmissive optical element. This same counterbore feature is present on the rear optical element 26 at location 76.

It should be appreciated that the reflex sight with environmental seal on pivoting element 10 is very easy to repair in the event the inner frame 28 or transmissive optical element 56 are damaged. Instead of having to circumvent a sealed second lens common to existing reflex sights to access the inner frame 28, the user can unscrew retaining ring 42 from the forward end 16 of the outer housing 12 to remove the compressive element 50 and the inner frame. A replacement inner frame can then be inserted into the chamber 14 through the forward opening 18 of the outer housing. The reflex sight can then be returned to an operational state by replacing the compressive element and screwing the retaining ring back onto the forward end of the outer housing.

It should also be appreciated that the reflex sight with environmental seal on pivoting element 10 can maintain an improved lens alignment over the range of windage and elevation adjustment. By maintaining a more consistent lens alignment, there is a potential to improve image quality or even utilize previously unpractical optical layouts that may contain advanced optical elements, such as gradient index lenses or more complex lens geometry.

Figure 4:
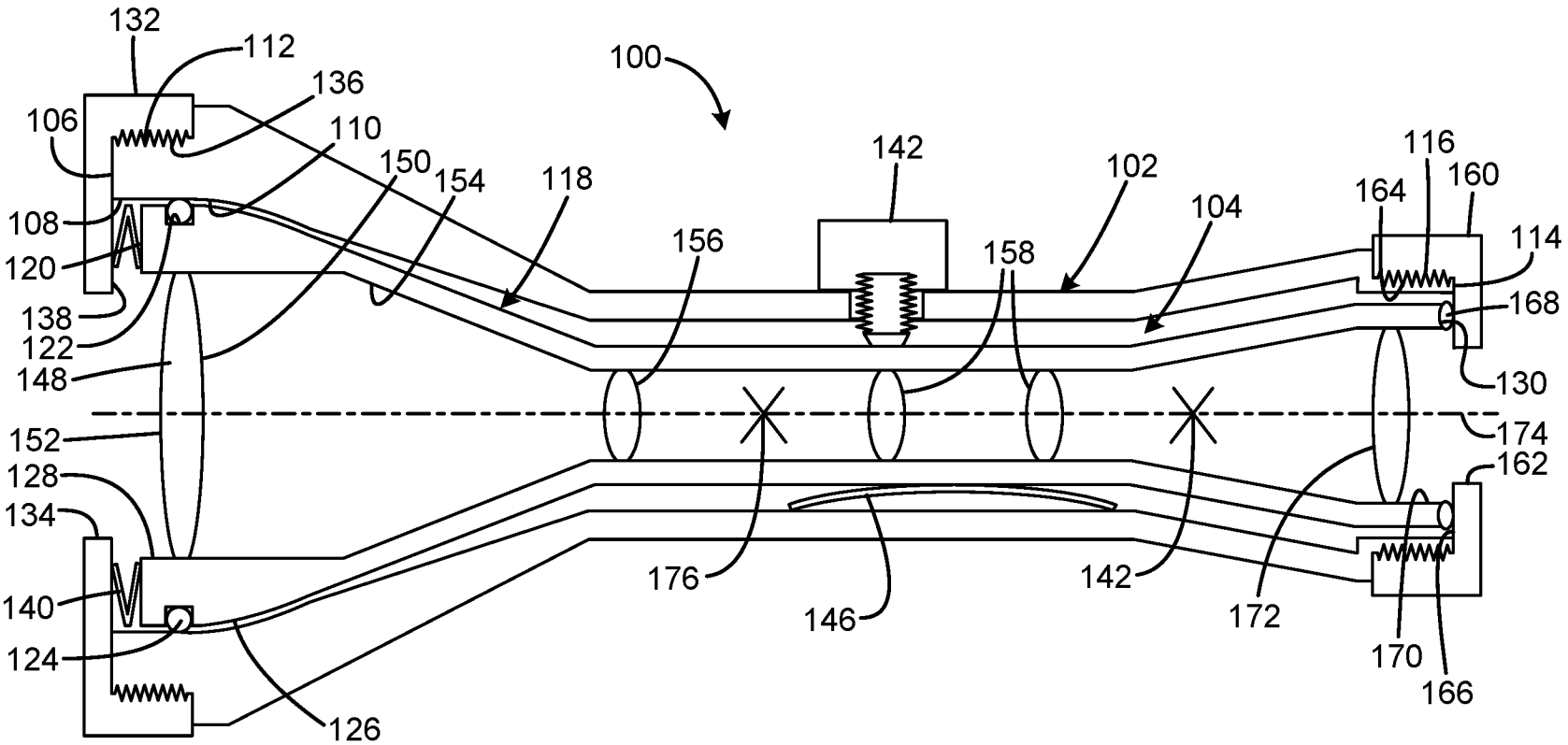
FIG. 4 is a left side sectional schematic view of a first alternative embodiment of the reflex sight with environmental seal on pivoting element incorporated into a rifle scope.

FIG. 4 illustrates a first alternative embodiment of the improved reflex sight with environmental seal on pivoting element 100 of the present invention. More particularly, the reflex sight with environmental seal on pivoting element 100 shows the dynamic water seal mechanism of the reflex sight 10 can function for a magnified optic/rifle scope as well. An elongated, tubular outer housing 102 defining a chamber 104 and having a forward end 106 defining a forward opening 108 having a seat surface 110. The forward end of the outer housing includes a threaded exterior portion 112. The outer housing also has a rear end 114 with a threaded exterior portion 116.

An elongated, tubular inner frame 118 is received within the chamber 104. The inner frame has a forward end 120. The forward end of the inner frame defines an exterior circumferential groove 122. A seal element 124 encompasses the forward end of the inner frame and is received in the circumferential groove. In the current embodiment, the seal element is an elastomeric ring. The seal element is closely received in the forward opening 108 of the outer housing to sealably contact the seat surface 110 and provide an environmental seal. The forward end of the inner frame has a spherical exterior portion 126. The forward end of the inner frame defines a forward aperture 128. The inner frame also has a rear end 130 and an interior 154.

A retaining ring 132 defining an open aperture 134 is removably connected to the outer housing 102 by a threaded interior portion 136 that threadedly engages the threaded exterior portion 112 of the outer housing. The retaining ring has a rear surface 138 that captures the forward end 120 of the inner frame 118. A compressive element 140 is interposed between the retaining ring and the forward end of the inner frame. In the current embodiment, the compressive element is a single turn gap type wave spring manufactured by Smalley Steel Ring Company of Lake Zurich, Ill.

A first aiming mechanism 142 and second aiming mechanism (not visible) are operably interconnected to the outer housing 102 and the inner frame 118 to adjustably position the middle 144 of the inner frame with respect to the outer housing in combination with an system spring 146 to align the inner frame to a desired angular disposition relative to the outer housing. In the current embodiment, the first aiming mechanism is a common turret adjustment mechanism for riflescopes for adjusting elevation, and the second aiming mechanism is a common turret adjustment mechanism for riflescopes for adjusting windage. It should be appreciated that an ocular lens assembly 172 pivots as the rear end of the inner frame moves.

The forward aperture 128 of the inner frame 118 sealably receives the ocular lens assembly 148. In the current embodiment, the ocular lens assembly is a magnifying element having a convex rear surface 150 and an exposed front surface 152. The ocular lens assembly is the only optical element at the forward end 106 of the outer housing 102.

The interior 154 of the inner frame also receives a second objective lens 156 and two relay lenses 158, with a front focal plane 176 and a rear focal plane 142. A rearward aperture 170 of the inner frame 118 sealably receives an ocular lens assembly 172 adjacent to the rear end 130. A retaining ring 160 defining an open aperture 162 is removably connected to the outer housing 102 by a threaded interior portion 164 that threadedly engages the threaded exterior portion 116 of the outer housing. The retaining ring has a rear surface 166 that captures the rear end 130 of the inner frame 118. A seal element 168 is interposed between the retaining ring and the rear end of the inner frame to create an environmental seal.

FIG. 4 is a schematic of a basic magnified optic utilizing a pivot near the objective lens assembly. The dynamic water seal mechanism created by seal element 124 on the seat surface 110 as the spherical exterior portion 126 of the inner frame 118 contacts the seat surface of the outer housing 102 could also be used near the ocular lens assembly 172, or anywhere along the optical axis 174. If the optical system is environmentally sealed, it may not be necessary to have a full environmental seal for the chamber 104.

Requiring a second lens to provide environmental protection can limit the adjustment range of conventional magnified optics for extreme long-range shooting. Currently, it is popular to utilize angled bases to tilt the rifle scope relative to the firearm bore axis to optimize the existing elevation adjustment range for longer range shooting. In contrast, the current invention can tilt to extreme angles for extreme elevation/windage adjustment capability without the issues traditional optical sighting adjustments experience.

While current embodiments of a reflex sight with environmental seal on pivoting element have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An optical sight for a firearm comprising:

an outer housing defining a chamber and having a forward end defining a forward opening having a seat surface and an opposed rear end;

an inner frame received within the chamber and having a forward end registered with the outer housing forward end and an opposed rear end;

the forward end of the inner frame defining a forward aperture sealably receiving a transmissive optical element;

a seal element encompassing the forward end of the inner frame and closely received in the forward opening of the outer housing to sealably contact the seat surface and provide an environmental seal;

a retaining ring defining an open aperture and removably connected to the outer housing and having a rear surface capturing the forward end of the inner frame;

a compressing element interposed between the retaining ring and the forward end of the inner frame; and an aiming mechanism operably interconnected to the outer housing and the inner frame to adjustably position the rear end of the inner frame with respect to the outer housing.

2. The optical sight of claim 1 wherein the seat surface is a concave curved surface.

3. The optical sight of claim 1 wherein the seat surface is a spherical surface portion.

4. The optical sight of claim 1 wherein the seat surface is a band having a width selected to enable a selected angular range of adjustment by the aiming mechanism.

5. The optical sight of claim 1 wherein the seat surface is defined by a common radius from a selected center point.

6. The optical sight of claim 5 wherein the center point is the center of pivot of the inner frame.

7. The optical sight of claim 5 wherein the center point is forward of the transmissive optical element.

8. The optical sight of claim 1 wherein the forward end of the inner frame has a spherical exterior portion.

9. The optical sight of claim 1 wherein the forward end of the inner frame defines a circumferential groove.

10. The optical sight of claim 9 wherein the seal element is an elastomeric ring received in the circumferential groove.

11. The optical sight of claim 1 wherein the inner frame includes a light emitting element positioned to reflect off the transmissive optical element to provide an aiming point as viewed from the rear end of the outer housing.

12. The optical sight of claim 1 wherein the transmissive optical element is a non-magnifying element having a concave rear surface.

13. The optical sight of claim 1 wherein the transmissive optical element has an exposed front surface.

14. The optical sight of claim 1 including a rear optical element connected to the outer housing and enclosing the chamber to provide an environmental seal.

15. The optical sight of claim 1 wherein the transmissive optical element is the only optical element at the forward end of the outer housing.

16. An optical sight for a firearm comprising:

an outer housing defining a chamber and having a first end defining an opening having a seat surface and an opposed rear end;

an inner frame received within the chamber and having a first end registered with the outer housing first end and an opposed second end;

the first end of the inner frame defining a first aperture sealably receiving a transmissive optical element;

a seal element encompassing the first end of the inner frame and closely received in the first opening of the outer housing to sealably contact the seat surface and provide an environmental seal; and a retaining ring defining an open aperture and removably connected to the outer housing and having a rear surface capturing the first end of the inner frame;

a compressing element interposed between the retaining ring and the first end of the inner frame;

an aiming mechanism operably interconnected to the outer housing and the inner frame to adjustably position the second end of the inner frame with respect to the outer housing.

17. The optical sight of claim 16 wherein the seat surface is a concave curved surface.

18. The optical sight of claim 16 wherein the seat surface is a spherical surface portion.

19. The optical sight of claim 1 wherein the compressive element is a spring.

20. The optical sight of claim 1 wherein the compressive element is a ring defining a central aperture.

* * * * *